US005192225A

United States Patent [19]

Suzuki

[11] Patent Number: 5,192,225

[45] Date of Patent: Mar. 9, 1993

[54] CONNECTOR LOCKING CONNECTION DETECTION DEVICE

[75] Inventor: Tetsuaki Suzuki, Shizuoka, Japan

[73] Assignee: Yazaki Corporation, Tokyo, Japan

[21] Appl. No.: 786,517

[22] Filed: Nov. 1, 1991

[30] Foreign Application Priority Data

Nov. 8, 1990 [JP] Japan ..... 2-301097
Nov. 9, 1990 [JP] Japan ..... 2-302786

[51] Int. Cl.[5] ..... H01R 3/00

[52] U.S. Cl. ..... 439/489; 439/350; 439/352

[58] Field of Search ..... 439/350, 352, 347, 488, 439/489, 357

[56] References Cited

U.S. PATENT DOCUMENTS

| | | | |
|---|---|---|---|
| 4,370,013 | 1/1983 | Niitsa et al. | 439/352 |
| 4,634,204 | 1/1987 | Delter et al. | 439/488 |
| 4,950,179 | 8/1990 | Takenouchi et al. | 439/352 |
| 4,984,998 | 1/1991 | Duncan et al. | 439/352 |
| 5,041,017 | 8/1991 | Nakazato et al. | 439/352 |

FOREIGN PATENT DOCUMENTS

| | | |
|---|---|---|
| 59-29351 | 8/1984 | Japan . |
| 250982 | 4/1990 | Japan . |

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

In a connector, a locking connection detection member is beforehand attached to a rear portion of a male connector housing and is retained thereto by resilient retaining pieces of the locking connection detection member in such a manner that the locking connection detection member is extended rearwardly from the male connector housing. Engagement release projections for the resilient retaining pieces are provided on the female connector housing so that when the male and female connector housing are completely connected together with the lock arm engaged with the engagement portion, the engagement release projections release the retaining of the resilient retaining piece, thereby enabling the removal of the locking connection detection member. According to this arrangement, a complete connection of a connector can be detected easily.

10 Claims, 8 Drawing Sheets

CONNECTOR LOCKING CONNECTION DETECTION DEVICE

BACKGROUND OF THE INVENTION

This invention relates generally to a connector for connecting a wire harness for an automotive vehicle, and more particularly to a device for detecting a locking connection between a pair of connectors.

FIGS. 1 and 2 show a conventional connector.

In FIG. 1, a flexible lock arm c of the cantilever type is formed on a surface of a male connector housing a, and is extended forwardly. An engagement hole d for a retaining portion cl of the flexible lock arm c is formed in a female connector housing b.

In the above construction, when the male and female connector housings a and b are to be connected together, the retaining portion cl of the flexible lock arm c is abutted against a front end of an engagement frame portion dl of the female connector housing b, and is displaced downward, and then the retaining portion cl is received in the engagement hole d, and is restored to its initial form to thereby complete the locking connection, thus providing a completely locked condition.

In this condition, an unlock prevention piece e is fitted on the flexible lock arm c to partially fill in a gap f between the flexible lock arm c and the surface of the male connector housing a, thereby preventing a subsequent displacement of the flexible lock arm c to prevent the unlocking (FIG. 2).

In an incompletely locked condition in which the retaining portion cl is not engaged in the engagement hole d, the flexible lock arm c is kept displaced downward with the gap f reduced, and therefore it is impossible to connect the unlock prevention piece e to the flexible lock arm c. With this arrangement, the incomplete connection between the pair of connector housings is detected (Japanese Utility Model Publication No. Sho. 59-29351).

In the above conventional art, the unlock prevention piece e, having the function of detecting the incomplete connection, must be attached to the flexible lock arm c when the pair of connector housings are connected together, and therefore extra labor is required for the detection, and besides this is cumbersome from the viewpoint of the management of the parts.

SUMMARY OF THE INVENTION

With this problem in view, it is an object of this invention to provide a construction by which a complete connection of a connector can be detected easily.

The above object has been achieved by a connector locking connection detection device comprising: a male connector housing having a flexible lock arm; a female connector housing having an engagement portion for the flexible lock arm; a locking connection detection member to be attached to a rear portion of the male connector housing in advance of mating the male and female connector housings; resilient retaining pieces for retaining the locking connection detection member to the rear portion of the male connector housing in such a manner that the locking connection detection member is extended rearwardly from the male connector housing; and engagement release projections for the resilient retaining pieces, provided on the female connector housing; wherein when the male and female connector housings are completely connected together with the lock arm engaged with the engagement portion, the engagement release projections release the retaining of the resilient retaining pieces, thereby enabling the removal of the locking connection detection member.

The locking connection detection member may include an incomplete connection detection retaining portion with which the flexible lock arm is engaged when the male and female connector housings are mated together but the lock arm is not engaged with the engagement portion.

The resilient retaining pieces may be provided on the locking connection detection member, or otherwise, may be provided in the male connector housing.

In the former case, it is preferable that the locking connection detection member includes stopper projections, each of the resilient retaining pieces is formed with a first retaining projection at a predetermined position apart from the stopper projections and the male connector housing includes second retaining projections at the reat end thereof so that each of the second retaining projections is interposed between the stopper projections and the first retaining projection to retain the locking connection detection member to the rear portion of the male connector housing.

In the latter case, it is preferable that the resilient retaining pieces are provided within receiving chambers passing through the male connector housing from its front end to its rear end thereof, the locking connection detection member includes forwardly-directed retaining pieces so that the forwardly-directed retaining pieces are engaged with the resilient retaining pieces within the receiving chambers for retaining the locking connection detection member to the rear portion of the male connector housing.

Terminal retaining chambers not retaining terminals and terminal retaining pieces in the terminal retaining chambers not retaining terminals may be used as the receiving chambers and the resilient retaining pieces, respectively.

DETAILED DESCRIPTION OF THE PREFERRED EMBODIMENTS

FIGS. 3 to 5B show a connector having a connector locking connection detection device according to an embodiment of the present invention.

Figure 1:
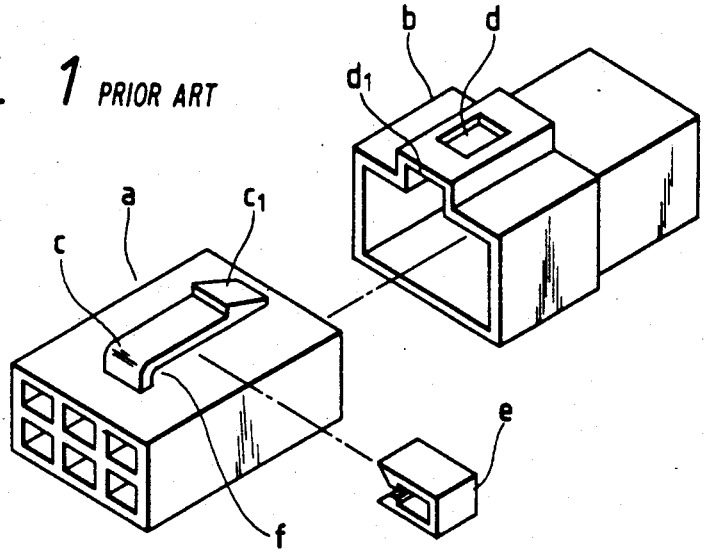
FIG. 1 PRIOR ART
FIG. 1 is an exploded perspective view of the conventional art.
Figure 2:
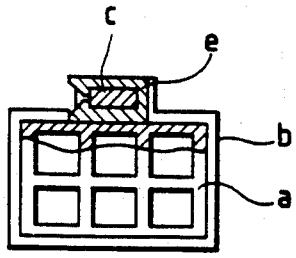
FIG. 2 PRIOR ART
FIG. 2 is a cross-sectional view of the above conventional art.
Figure 3:
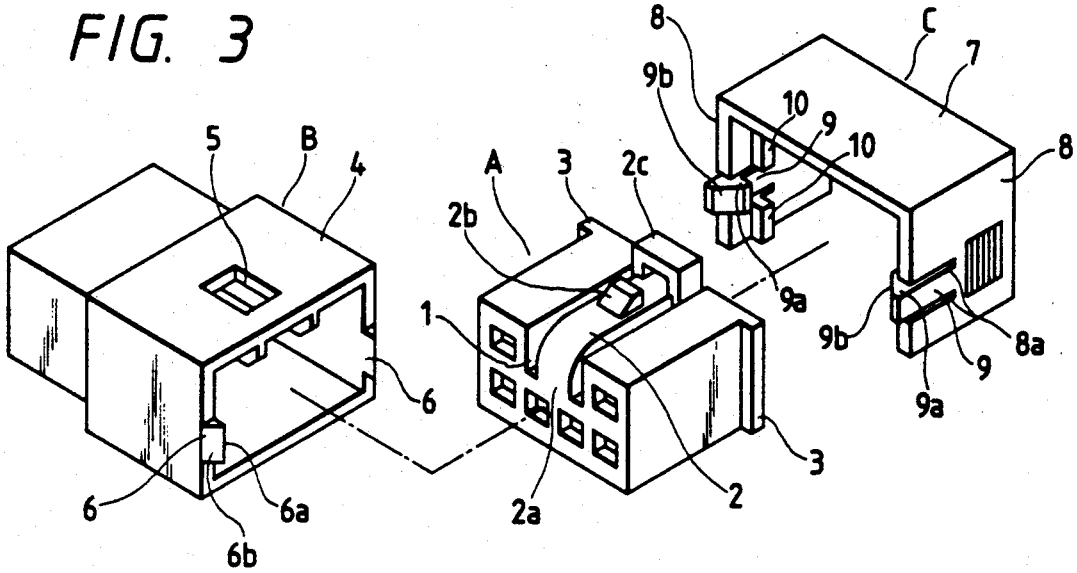
FIG. 3 is an exploded perspective view of one embodiment of the present invention.

In FIG. 3, reference character A denotes a male connector housing, reference character B a female connector housing, and reference character C a locking connection detection member. These are made of a synthetic resin.

The male connector housing A has a groove 1 formed in its upper surface thereof and extending from its front to its rear end, and a flexible lock arm 2 which is received in the groove 1 and is extended rearwardly via its upstanding proximal portion 2*a*. This flexible lock arm has a lock projection 2*b* intermediate the opposite ends thereof, and an operating portion 2*c* at the rear end thereof. Retaining projections 3 for the locking connection detection member C are formed respectively on the right and left side surfaces of the male connector housing A at the rear end thereof, and are directed right and left, respectively.

An engagement portion 5 for the lock projection 2*b* is notched in a sleeve portion 4 of the female connector housing B, and engagement release projections 6 are formed respectively on the right and left portions of the front end of the sleeve portion 4. The engagement release projections are directed forwardly, and have respective sharp tip edges 6*a* and respective tapered drive surfaces 6*b* directed right and left, respectively.

The locking connection detection member C is of a U-shape defined by a top plate portion 7 and a pair of side plate portions 8 and 8 extending from the opposite ends of the top plate portion 7. Each of the two side plate portions 8 has a resilient retaining piece 9 formed at the front end portion thereof as a result of the provision of slits 8*a*, the resilient retaining piece 9 having a retaining projection 9*a*. The retaining projection 9*a* has a tapered driven surface 9*b* at its inner side. Stopper projections 10 are formed on the inner surface of each side plate portion 8 in spaced relation to the retaining projection 9*a*.

Figure 4A:
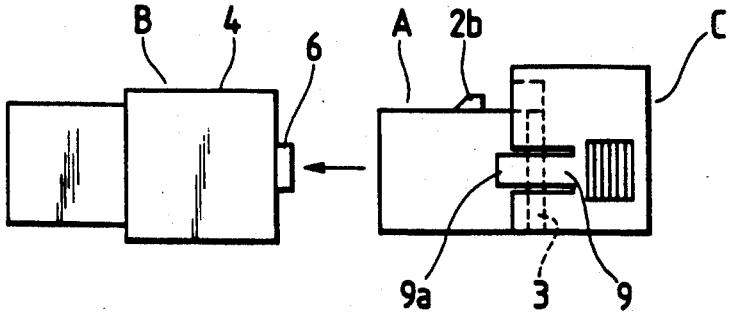
FIGS. 4A, 4B, 4C and 4D are side-elevational views showing the process of connection between male and female connector housings.

In the above construction, the locking connection detection member C is beforehand connected to the male connector housing A and is extended rearwardly therefrom in such a manner that the retaining projections 9*a* of the resilient retaining pieces 9 are engaged respectively with the retaining projections 3 (FIG. 4A).

Figure 4B:
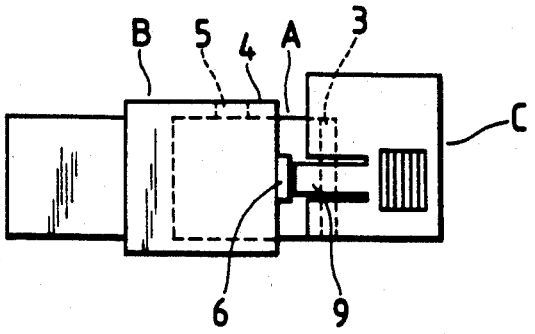
Figure 4C:
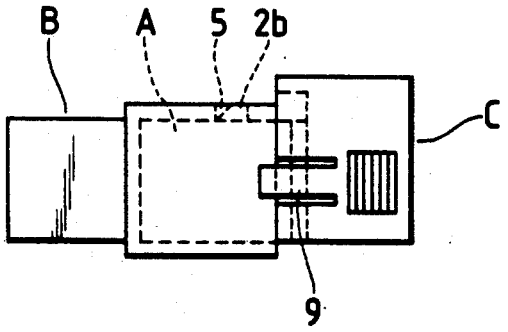
Figure 4D:
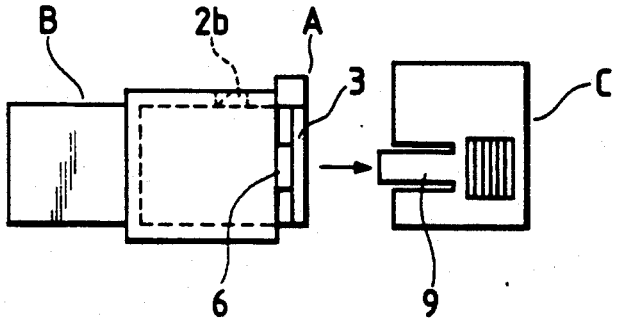
Figure 5A:
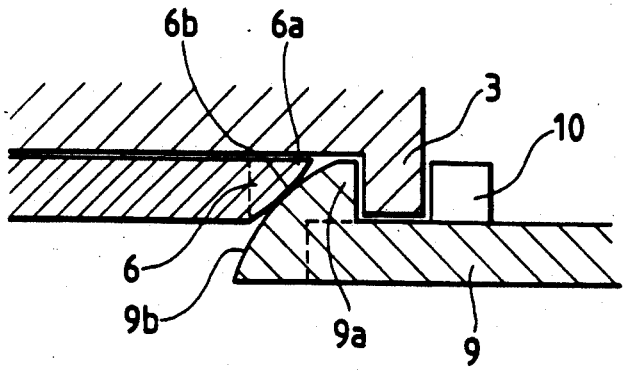
FIGS. 5A and 5B are cross-sectional views of an important portion, showing the above connecting process.
Figure 5B:
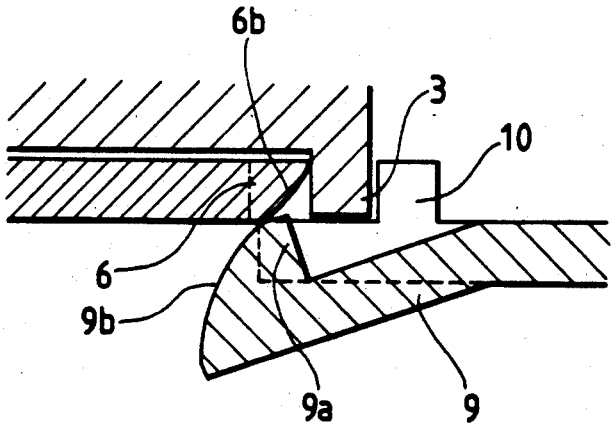
Figure 6:
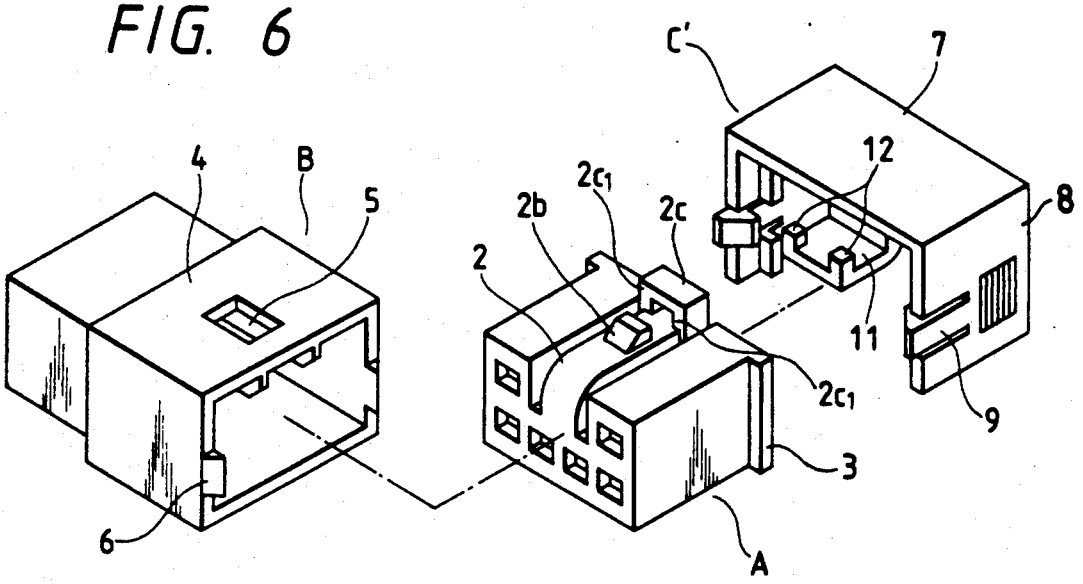
FIG. 6 is an exploded perspective view of another embodiment.
Figure 7:
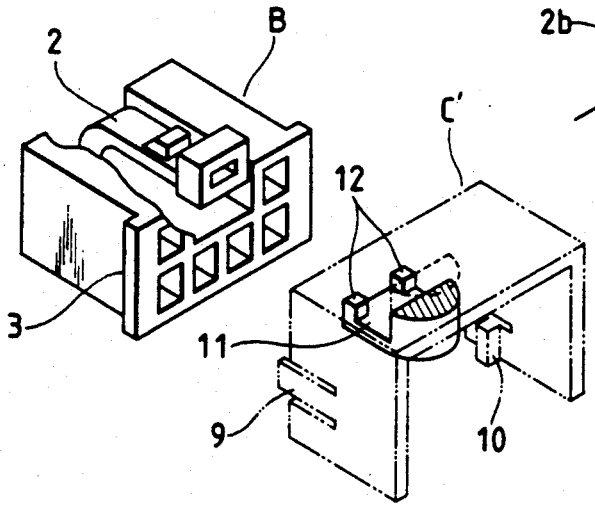
FIG. 7 is an exploded perspective view of said another embodiment with an important portion thereof broken.
Figure 8:
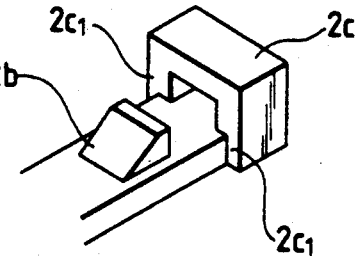
FIG. 8 is an enlarged perspective view of a flexible lock arm of said another embodiment.

In this condition, when the male connector housing A is fitted into the female connector housing B by holding the locking connection detection member C, the lock projection 2*b* is abutted against the front end of the sleeve portion 4, and the flexible lock arm 2 is displaced downward, and at the same time the engagement release projections 6 are abutted respectively against the retaining projections 9*a* of the resilient retaining pieces 9 (FIGS. 4B and 5A). When the male connector housing A is completely fitted in the female connector housing B, the flexible lock arm 2 is restored to its initial form, so that the lock projection 2*b* is engaged in the engagement portion 5, and metal terminals (not shown) contained in the two connector housings are connected together. At the same time, the tapered drive surfaces 6*b* of the engagement release projections 6 respectively displace the resilient retaining pieces 9 outwardly through the tapered driven drive surfaces 9*b* in such a manner that the retaining projections 9*a* are disengaged from the retaining projections 3, respectively (FIGS. 4C and 5B). In this condition, the locking connection detection member C is removed, thereby detecting the complete connection between the pair of connectors (FIG. 4D).

In an embodiment shown in FIGS. 6 to 9D, in addition to the above construction, an engagement plate portion 11 for receiving the operating portion 2*c* of the flexible lock arm 2 of the male connector housing A in a manner to allow displacement thereof is provided on the inner side of a top plate portion 7 of a locking connection detection member C'. Incomplete connection detection retaining portions 12 for engagement with projections $2c_1$ provided respectively on the opposite sides of the operating portion 2*c* are formed on the engagement plate portion 11.

Figure 9A:
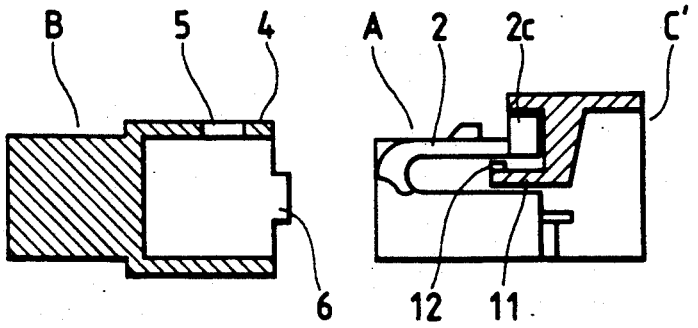
FIGS. 9A, 9B, 9C and 9D are cross-sectional views showing the process of connection of male and female connector housings of said another embodiment.

In this case, the locking connection detection member C' is connected to the male connector housing A as shown in FIG. 9A, and in this condition the operating portion 2*c* of the flexible lock arm 2 is not engaged with the incomplete connection detection retaining portions 12.

Figure 9B:
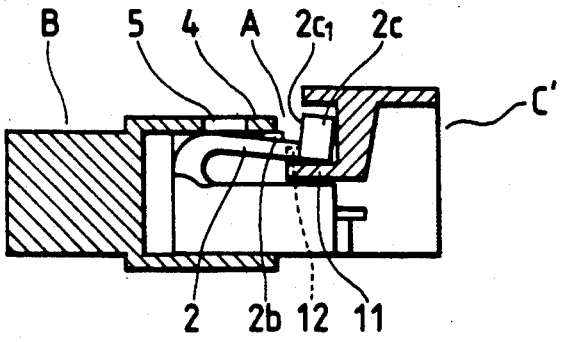
Figure 9C:
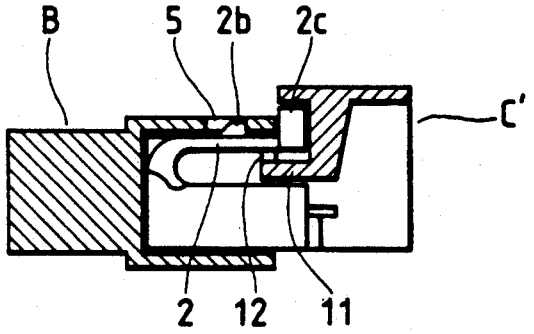

In the condition in which the male connector housing A is incompletely fitted in the female connector housing B, the flexible lock arm 2 is displaced downward, and therefore the projections $2c_1$ of the operating portion 2*c* are engaged with the incomplete connection detection retaining portions 12, thereby preventing the locking connection detection member C' from being disengaged from the male connector housing A (FIG. 9B).

Figure 9D:
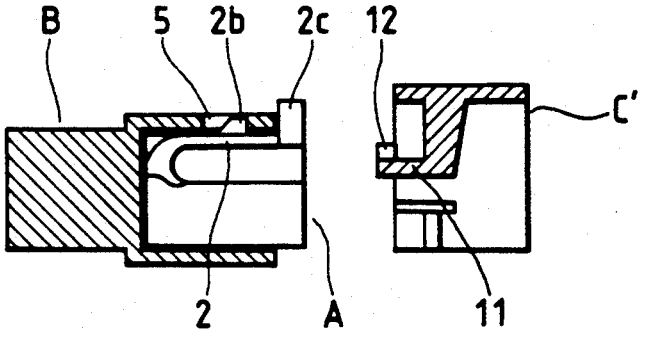
Figure 10:
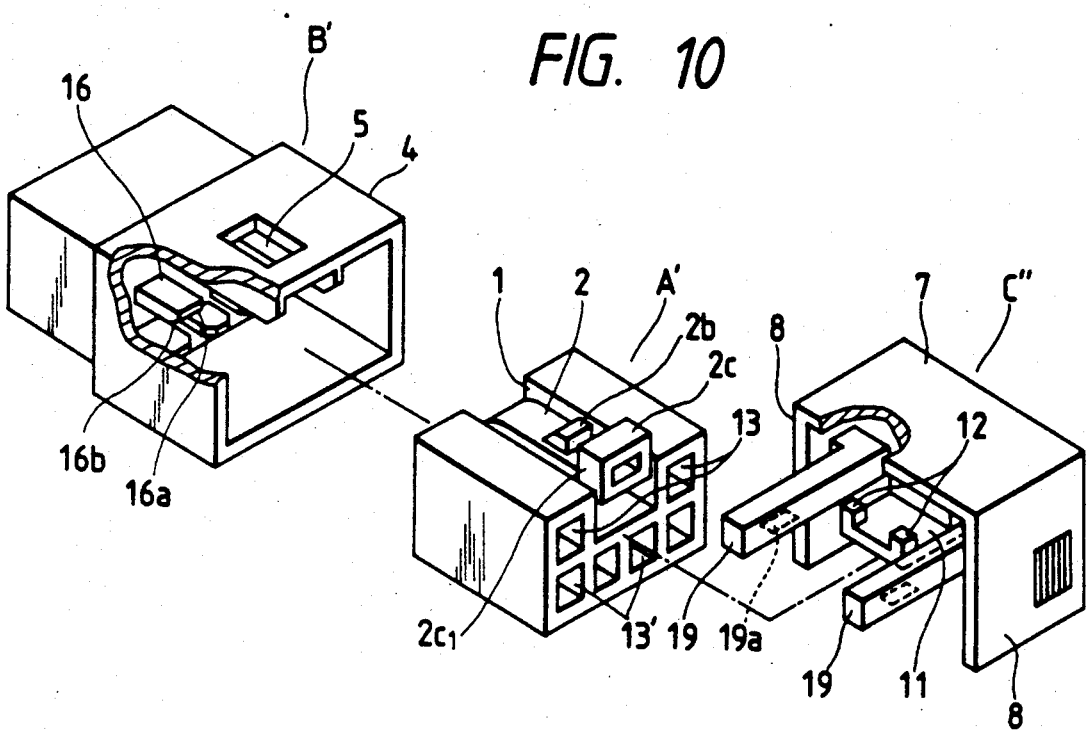
FIG. 10 is an exploded perspective view of yet another embodiment of the present invention.
Figure 11:
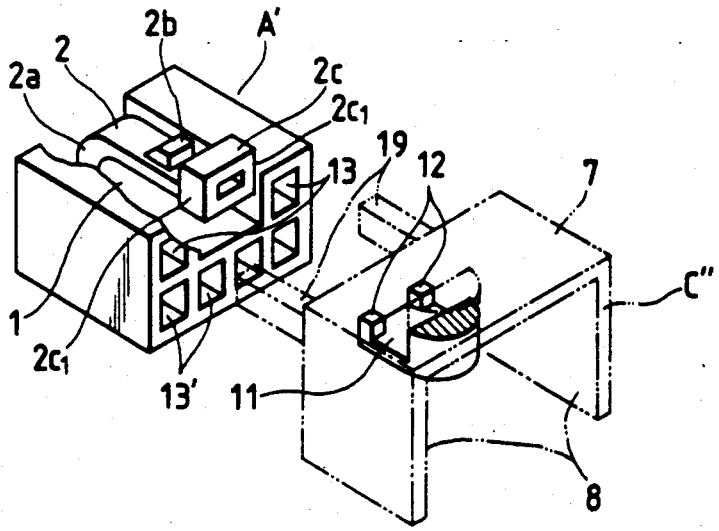
FIG. 11 is an exploded perspective view of the above embodiment shown in FIG. 10 with an important portion thereof broken.

When the male connector housing A and the female connector housing B are completely connected together, the flexible lock arm 2 is restored to its initial form, and the lock projection 2*b* is engaged in the engagement portion 5. As a result, the engagement between the operating portion 2*c* and the incomplete connection detection retaining portions 12 is released (FIG. 9C), and as described above, each engagement release projection 6 releases the engagement between the resilient retaining piece 9 and the retaining projection 3, and therefore the locking connection detection piece C' can be detached from the male connector housing A (FIG. 9D).

In an embodiment shown in FIGS. 10 to 13D, a resilient retaining piece 13*a* is provided within each of receiving chambers 13. Terminal receiving chambers 13' for retaining terminals and the receiving chambers 13 for receiving retaining pieces (later described) of the locking connection detection member C'', extend through the male connector housing from its front to its rear end. Engagement release projections 16 are provided within the sleeve portion 4 and are directed forwardly. Each of the engagement release projection 16 has a sharp edge 16*a* at its front end, and a tapered drive surface 16*b* directed downwardly. Forwardly-directed retaining pieces 19 each having an engagement hole 19*a* are formed respectively on the inner surfaces of the side plate portions 8.

Figure 12A:
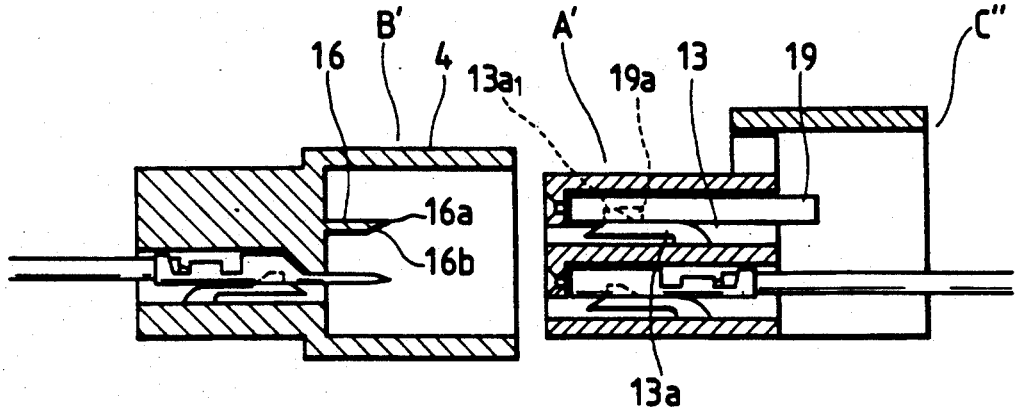
FIGS. 12A, 12B and 12C are cross-sectional views showing the process of connection in the above embodiment shown in FIG. 10.
Figure 13A:
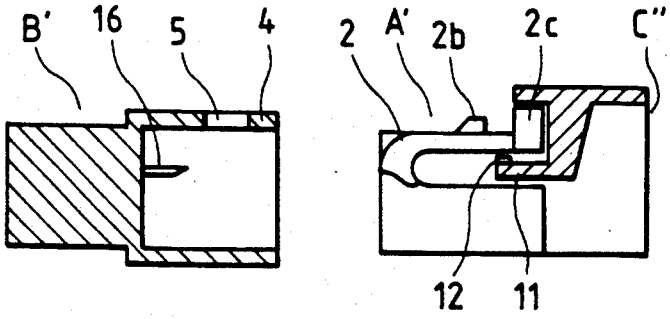
FIGS. 13A, 13B, 13C and 13D are cross-sectional views showing the above connecting process.

In the above construction, the locking connection detection member C'' is beforehand connected to the male connector housing A' and is extended rearwardly therefrom in such a manner that the retaining pieces 19 are received respectively in the receiving chambers 13 of the male connector housing A', with retaining projections $13a_1$ of the resilient retaining pieces 13a received respectively in the engagement holes 19a (FIGS. 12A and 13A).

Figure 12B:
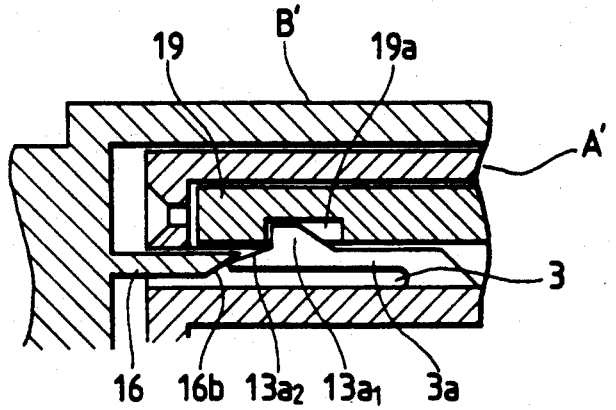
Figure 12C:
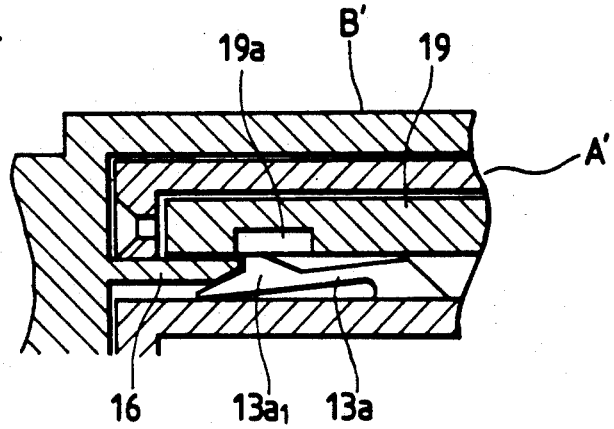
Figure 13B:
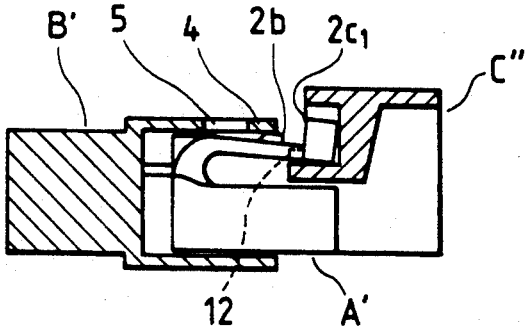
Figure 13C:
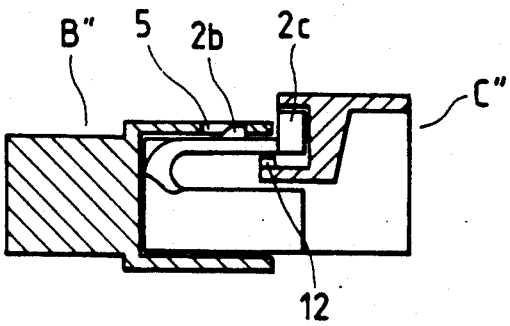
Figure 13D:
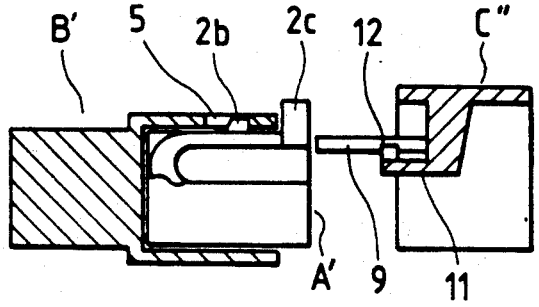

In this condition, when the male connector housing A' is fitted into the female connector housing B' by holding the locking connection detection member C'', the lock projection 2b is abutted against the front end of the sleeve portion 4, and the flexible lock arm 2 is displaced downward. At the same time the projections $2c_1$ of the operating portion 2c are engaged respectively with the incomplete connection detection retaining portions 12, and also the tapered drive surfaces 16b of the engagement release projections 16 are abutted respectively against tapered driven surfaces $13a_2$ of the resilient retaining pieces 13a (FIGS. 12B and 13B). When the male connector housing A' is completely fitted in the female connector housing B', the flexible lock arm 2 is restored to its initial form, and as a result the engagement between the operating portion 2c and the incomplete connection detection retaining portions 12 is released, and also the lock projection 2b is engaged in the engagement portion 5. At this time, the tapered drive surfaces 16b of the engagement release projections 16 respectively displace the resilient retaining pieces 13a through the tapered driven drive surfaces $13a_2$ in such a manner that the retaining projections $13a_1$ are disengaged from the retaining holes 19a of the retaining pieces 19, respectively (FIGS. 12C and 13C). In this condition, the locking connection detection member C'' is removed, thereby detecting the complete connection between the pair of connectors (FIG. 13D).

As described above, the present invention provides the connector locking connection detection device comprising the male connector housing having the flexible lock arm, and the female connector housing having the retaining portion for the flexible lock arm; wherein the locking connection detection member is beforehand attached to the rear portion of the male connector housing and is retained thereto by the resilient retaining means in such a manner that the locking connection detection member is extended rearwardly from the male connector housing; the engagement release projections for the resilient retaining means are provided on the female connector housing; and when the male and female connector housing are completely connected together with the lock arm engaged with the engagement portion, the engagement release projections release the retaining of the resilient retaining means, thereby enabling the removal of the locking connection detection member. Therefore, by removing the locking connection detection member, the complete connection of the connector can be confirmed easily and rapidly, and the removed locking connection detection member can be again used for attachment to another connector housing.

Further, since the locking connection detection member is attached to the male connector housing in such a manner that the detection is extended rearwardly from the male connector housing, the male connector housing can be fitted into the female connector housing while holding the locking connection detection member with an operator's hand when the male and female connector housings are to be connected together, and therefore the connecting operation is facilitated.

What is claimed is:

1. A connector locking connection detection device comprising:

a male connector housing having a flexible lock arm;

a female connector housing having an engagement portion for said flexible lock arm;

a locking connection detection member to be attached to a rear portion of said male connector housing in advance of mating said male and female connector housings;

resilient retaining pieces for retaining said locking connection detection member to the rear portion of said male connector housing in such a manner that said locking connection detection member is extended rearwardly from said male connector housing; and engagement release projections for said resilient retaining pieces, provided on said female connector housing; wherein when said male and female connector housings are completely connected together with said lock arm engaged with said engagement portion, said engagement release projections acting to disengage said resilient retaining pieces, thereby enabling the removal of said locking connection detection member.

2. The device according to claim 1, wherein said locking connection detection member includes an incomplete connection detection retaining portion with which said flexible lock arm is engaged when said male and female connector housings are mated partially together but said lock arm is not engaged with said engagement portion.

3. The device according to claim 1, wherein said engagement release projections are formed with tapered drive surfaces for resiliently displacing said resilient retaining pieces when said male and female connector housings are completely connected together with said lock arm engaged with said engagement portion.

4. The device according to claim 1, wherein said resilient retaining pieces are provided on said locking connection detection member.

5. The device according to claim 4, wherein said locking connection detection member includes stopper projections, and each of said resilient retaining pieces is formed with a first retaining projection spaced a predetermined distance from said stopper projections.

6. The device according to claim 5, wherein said male connector housing includes second retaining projections at the rear end thereof, each of said second retaining projections being interposed between said stopper projections and said first retaining projection to retain said locking connection detection member to the rear portion of said male connector housing.

7. The device according to claim 1, wherein said resilient retaining pieces are provided in said male connector housing.

8. The device according to claim 7, wherein said male connector housing is formed with terminal retaining chambers provided with terminal retaining pieces for retaining terminals within said terminal retaining chambers, and terminal retaining pieces in terminal retaining chambers not retaining terminals serves for said resilient retaining pieces.

9. The device according to claim 7, wherein said male connector housing is formed with receiving chambers passing through said male connector housing from its front end to its rear end, said resilient retaining pieces being provided within said receiving chambers.

10. The device according to claim 9, wherein said locking connection detection member includes forwardly-directed retaining pieces engaged with said resilient retaining pieces within said receiving chambers for retaining said locking connection detection member to the rear portion of said male connector housing.

* * * * *